US010334909B2

(12) United States Patent
Knez

(10) Patent No.: US 10,334,909 B2
(45) Date of Patent: Jul. 2, 2019

(54) ELASTIC SHOELACE WITH A RING

(71) Applicant: David Knez, Sava (SI)

(72) Inventor: David Knez, Sava (SI)

( * ) Notice: Subject to any disclaimer, the term of this patent is extended or adjusted under 35 U.S.C. 154(b) by 0 days.

(21) Appl. No.: 15/559,856

(22) PCT Filed: Sep. 28, 2015

(86) PCT No.: PCT/SI2015/000030
§ 371 (c)(1),
(2) Date: Sep. 20, 2017

(87) PCT Pub. No.: WO2016/153436
PCT Pub. Date: Sep. 29, 2016

(65) Prior Publication Data

US 2018/0055147 A1 Mar. 1, 2018

(30) Foreign Application Priority Data

Mar. 20, 2015 (SI) ..... 201500070

(51) Int. Cl.

| | |
|---|---|
| ***A43C 9/02*** | (2006.01) |
| ***A43C 1/02*** | (2006.01) |
| ***A43C 1/04*** | (2006.01) |
| ***A43C 7/00*** | (2006.01) |
| ***A43C 11/24*** | (2006.01) |

(52) U.S. Cl.
CPC ..... *A43C 9/02* (2013.01); *A43C 1/02* (2013.01); *A43C 1/04* (2013.01); *A43C 7/00* (2013.01); *A43C 11/24* (2013.01); *Y10T 24/3726* (2015.01)

(58) Field of Classification Search
CPC . Y10T 24/3726; Y10T 24/37; Y10T 24/3787; Y10T 24/3711; A43C 9/02; A43C 9/06; A43C 7/00
See application file for complete search history.

(56) References Cited

U.S. PATENT DOCUMENTS

| | | | | | |
|---|---|---|---|---|---|
| 376,041 | A * | 1/1888 | Murdock | A43C 7/00 | 24/712.4 |
| 421,321 | A * | 2/1890 | Schoonmaker | A43C 3/00 | 24/714.4 |
| 490,997 | A * | 1/1893 | Timmerman | A43C 9/00 | 24/713 |
| 1,142,199 | A * | 6/1915 | Olson | A43C 9/00 | 24/129 D |
| 1,458,088 | A * | 6/1923 | Unnold | A43C 7/00 | 24/713 |
| 1,669,537 | A * | 5/1928 | Schaffer | A43C 7/00 | 24/712.4 |
| 1,848,318 | A * | 3/1932 | Ciampi | A43C 9/06 | 24/713 |

(Continued)

FOREIGN PATENT DOCUMENTS

| | | |
|---|---|---|
| FR | 2 607 678 A1 | 6/1988 |
| GB | 244 957 A | 12/1925 |

*Primary Examiner* — Robert Sandy
*Assistant Examiner* — Michael S Lee
(74) *Attorney, Agent, or Firm* — Bay State IP, LLC

(57) ABSTRACT

The object of the invention is an elastic shoelace with an eye and a ring. The elastic shoelace of the invention can easily be passed through holes (B) in a shoe (A) and by increasing or decreasing the tightening of an elastic string (1) a ring (5) is hooked onto a threaded pin (4) thus achieving favorable shoe tying.

1 Claim, 1 Drawing Sheet

(56) References Cited

U.S. PATENT DOCUMENTS

Figure 1:
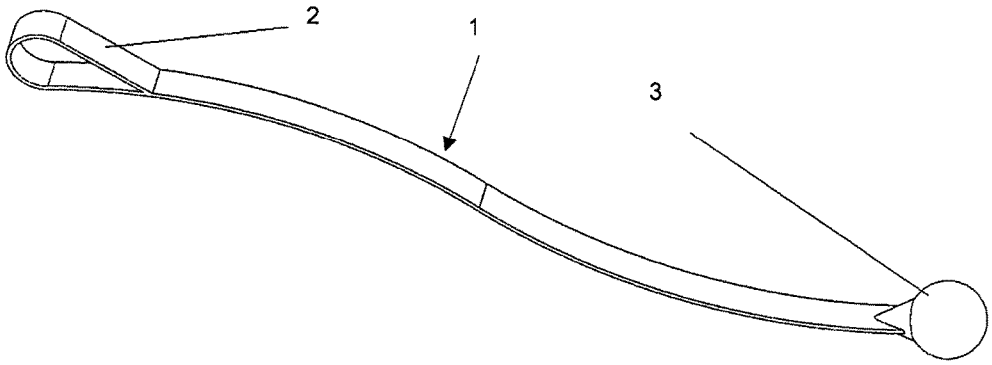

| | | | | |
|---|---|---|---|---|
| 2,049,932 | A * | 8/1936 | Voit | A43C 9/06 24/713 |
| 2014/0041167 | A1* | 2/2014 | Simmons | A43C 7/00 24/713 |
| 2017/0172257 | A1* | 6/2017 | Meraz | A43B 3/0078 |

* cited by examiner

ELASTIC SHOELACE WITH A RING

CROSS REFERENCE TO RELATED APPLICATION

This application is for entry into the U.S. National Phase under § 371 for International Application No. PCT/SI2015/000030 having an international filing date of Sep. 28, 2015, and from which priority is claimed under all applicable sections of Title 35 of the United States Code including, but not limited to, Sections 120, 363, and 365(c), and which in turn claims priority under 35 USC 119 to Slovenia Patent Application No. P-201500070 filed on Mar. 20, 2015.

The object of the invention is an elastic shoelace with an eye and a ring. It represents a new way of tying sports shoes, kids' shoes and elegant shoes. It is mostly intended for children and the elderly who find it hard to put on the shoes since it is quite easy to use. The elastic shoelace of the invention can easily be passed through holes in a shoe and by increasing or decreasing the tightening of the elastic string a ring is hooked onto a threaded pin thus achieving favourable shoe tying. The invention belongs to class A63C 9/06 of the International Patent Classification.

The technical problem that is successfully solved by the present variant of the elastic shoelace is a variant of such shoe tying that will be easy and will enable rapid shoe tying with a possibility of additional simple regulation of the pressure of the tied shoe against a foot.

We become aware of the importance of properly and adequately tied shoelaces only when the shoelaces are incorrectly tied. If the shoelaces are tightened too strongly, leg tiredness, pain, numbness in the feet and prevention of natural sweating of the feet are experienced. In this way, a shoe is less flexible and a foot in the shoe gets more slippery and less stable. Overtightened shoes can cause frictional heat in the foot and toe areas which often results in painful blisters.

A shoelace is actually a long string that is passed through holes on a shoe and at the end tied off and optionally tightened. It is normally tied off using a bow knot. This is the most commonly used way of tying and everyone can use it. However, shoelace tying is difficult for children as a bow knot needs to be made and adequately tightened. Children usually lack enough force and a shoelace can get untied. They therefore feel dissatisfied and if they fail to notice it they can step on a shoelace and get hurt.

There is also a variant of a spiral shoelace. This is a spirally wound elastic shoelace that is also passed through holes on a shoe. Due to its shape and elasticity the shoelace gets interwoven and somehow knotted. It does not need to be tied. Its drawback is that it cannot be optionally tightened in a controlled manner. Moreover, it can get knotted to such an extent that is cannot be loosen easily. It is also not suitable for all users due to its visual appearance.

One of known solutions is also an elastic shoelace having knots at both ends. The shoelace is arranged over the entire shoe in a way that it is inserted at a bottom end of a shoe into a first hole and a knot is made, while the other end is passed through the remaining holes and exits at the last upper hole of the shoe, then a knot is made and fastening is completed. One variant of such shoelace is disclosed in patent document US 2014/0041167. Another version of such shoelace that has an eye at one end and a hook at the other is disclosed in patent document US 2009/0229095. A disadvantage of such variants of shoelaces is that the upper knot needs to be loosened in case of too strong pressure of the tightened shoe against a foot, and then the fastening repeated with less strong pressure or by adapting the length of the shoelace in a different way.

The solution disclosed in patent document WO2013/149246 discloses a shoelace with an elastic core with a set of equidistantly arranged knots along the entire length of the shoelace. If the shoelace is stretched, the knots disappear and the shoelace can be passed through the holes. When the shoelace is relaxed, the knots reappear. More knots between the holes reduce the tension, less knots between the holes increase the tension. The shoelace with an elastic core is complicated for manufacturing and therefore expensive.

The solution disclosed in WO2010/030066 describes a manner of tightening a shoelace, in which a pair of specially shaped stoppers is arranged at an upper part of a shoe, through which an end of a shoelace is passed. The stoppers are activated by pulling the ends of the shoelace and the shoelace is fixed. It is loosened by pulling a tongue arranged on the shoelace between both stoppers. The solution is complicated for production and is not suitable for all types of footwear.

There is also a solution disclosed in patent documents WO2010/151614 and U.S. Pat. No. 1,772,238, where the holes in a shoe are linked by way of several short elastic linking elements—strings, which can be optionally arranged on a shoe.

The basic part of the elastic shoelace with an eye and a ring of the invention is an elastic string that fits the leg and increases comfort. The string is provided at one end with a knot and at the other end with a ring, with which the string can be fastened to one of threaded pins arranged on a shoe. By fixing a ring to a certain threaded pin, the elastic string is optionally tightened or loosened to reach comfort of a foot. The ring can be equipped with a tag, with which the shoelace is simply pulled and tightened at will.

Figure 2:
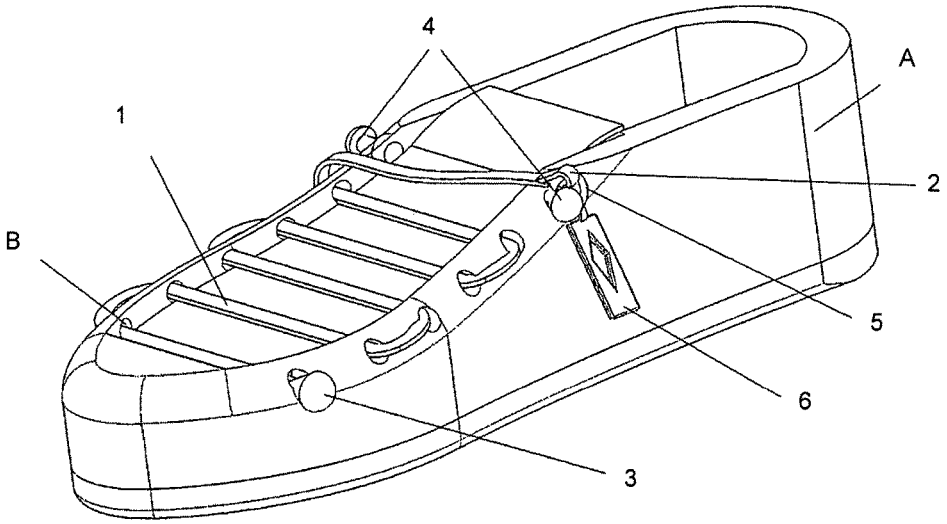

The invention will be explained in more detail by way of an embodiment and the enclosed drawings representing in:

FIG. 1 elastic string with a knot and a ring;

FIG. 2 arrangement of the elastic shoelace onto a shoe.

The embodiment of an elastic shoelace of the invention solves a problem of effortless rapid tightening of a shoelace. Since the shoelace is elastic, it fits the leg and does not pinch a person while walking. As the shoelace is provided with an eye 2 at one side of an elastic string 1 that is passed through the holes of the shoe, there is no need for metallic aglets and children can rapidly and permanently tighten their shoes easily and with no effort needed. The elastic string 1 of the shoelace is relatively short and stretchable, so there are no superfluous parts, over which one could stumble while walking and get hurt. One end of the elastic cord is provided with a knot 3 while the other is provided with an eye 2, through which a ring 5 is inserted; the ring 5 may be provided with a tag 6 that might function as a holder, with which the shoelace of the invention is tightened and handled. The knot 3 can be hidden into a lug.

When arranging the elastic shoelace of the invention, the knot 3 is first made to define an adequate length of the elastic string 1, the elastic string 1 is then inserted with the eye 2 through holes B in a shoe A from the lower section upwards. In fact, the elastic string 1 links the holes B between them by linking two adjacent holes B at one side of the shoe with two adjacent holes B of the shoe at the other side. The elastic string 1 thus gets arranged over the entire shoe A. The knot 3 at the end of the elastic string 1 is fixed behind the first bottom hole B of the shoe A, while the ring 5 is fixed onto the eye 2 which was pulled out of the last upper hole B of the shoe A.

The upper part of the shoe A is provided with threaded pins 4. The number of threaded pins 4 depends on user's requirements and the shape and height of the shoe. In the example shown in FIG. 2, a pair of threaded pins 4 is arranged at the upper part of the shoe A. The ring 5 which may also be provided with the tag 6 is hooked onto the threaded pin 4, whose position corresponds to the tightness of the elastic shoelace 1 of the invention. In the example from FIG. 2, the tightness of the elastic string 1 of the shoelace can be regulated between two positions, on which the threaded pins 4 are arranged.

In this way, the elastic shoelace of the invention is adequately arranged on the shoe A and needs not be re-arranged while taking the shoes off and putting them on. By simply placing the ring 5 to a different threaded pin 4, the tightness of the shoelace is regulated and consequently the pressure of the shoe against the foot is regulated, too.

The invention claimed is:

1. An elastic shoelace comprising:

a knot (3) located at one end of the elastic shoelace;

a circular eye (2) located opposite the knot at an other end of the elastic shoelace;

a ring (5) that is received by and located on the eye (2); and a tag (6) provided on the ring;

wherein the elastic shoelace is inserted with the eye (2) through a set of holes (B) in a lower section of a shoe (A) upwards and once the elastic shoelace is secured in the set of holes (B) in the shoe (A), the knot (3) is fixed behind a first bottom hole (B) of the shoe (A) and the ring (5) is hooked onto an adequate threaded pin (4) arranged on the shoe (A).

* * * * *